US005174870A

United States Patent [19]

Puma

[11] Patent Number: 5,174,870

[45] Date of Patent: Dec. 29, 1992

[54] ELECTROCLEANING METHOD

[75] Inventor: Jeff Puma, Wantagh, N.Y.

[73] Assignee: PCT Technology, Inc., Wantagh, N.Y.

[21] Appl. No.: 743,139

[22] Filed: Aug. 9, 1991

[51] Int. Cl.[5] ..... C25F 1/00; C11D 1/12; C03C 23/00; C23G 1/02

[52] U.S. Cl. ..... 204/141.5; 252/89.1; 252/541; 134/2; 134/3; 134/41

[58] Field of Search ..... 252/D11, 541, 89.1; 204/141.5; 134/2, 3, 41

[56] References Cited

U.S. PATENT DOCUMENTS

| | | | |
|---|---|---|---|
| 3,094,469 | 6/1963 | Strauss et al. | 204/141.5 |
| 4,010,086 | 3/1977 | Barrett et al. | 204/141.5 |
| 4,089,755 | 5/1978 | Steinecker | 205/313 X |
| 4,264,418 | 4/1981 | Wood et al. | 204/141.5 X |
| 4,444,630 | 4/1984 | Steinecker | 205/313 |
| 4,544,462 | 10/1985 | Furutani et al. | 204/141.5 X |
| 4,783,283 | 11/1988 | Stoddart | 252/89.1 |

*Primary Examiner*—Donald R. Valentine

[57] ABSTRACT

A liquid concentrate composition for use in the cleaning of a surface comprises a mixture of sodium di-isopropyl naphthalene sulfonate, trisodium nitrilotriacetate and sodium diethanolglycinate.

2 Claims, No Drawings

ELECTROCLEANING METHOD

BACKGROUND OF THE INVENTION

1. Field of the Invention

The present invention relates to a liquid concentrate composition for use in the cleaning of a surface comprising a mixture of sodium diisopropyl naphthalene sulfonate, trisodium nitrilotriacetate and sodium diethanolglycinate.

2. The Prior Art

U.S. Pat. No. 3,151,084, to Schiltz et al, discloses a detergent composition which includes the combination of a surface active agent and a sequestering or chelating agent. Specifically, in Col. 1, lines 63–72, this reference discloses the following organic compounds: sodium salts of ethylene diamine tetracetic acid (EDTA), nitrilo triacetic acid, along with alkyl aryl sulfonates. In Col. 2, lines 30–35, Schiltz discloses sodium salts of N,N-di(2-hydroxyethyl) glycine. Then, beginning in Col. 2, line 65 running through Col. 3, line 15, is the disclosure of alkali metal salts of naphthalene sulfonate, wherein the sulfonate has alkyl substituents having from 9 to 18 carbon atoms in the alkyl chain. Schitz et al also discloses that this detergent composition may be used in a slurry, or in an aqueous composition as either a concentrate or as a diluted composition. In addition, the Schiltz reference in column 2, line 40, teaches that it is well known to use chelating agents for the purposes of sequestering polyvalent metal ions such as magnesium, calcium and iron. However, there is no disclosure that the composition can be used as an electrolyte in an electrochemical metal cleaning or plating method, or to clean the epidermis of an animal.

U.S. Pat. No. 4,868,213, to Farrish, discloses a composition comprising a chelating agent such as sodium dihydroxyl ethyl glycine in combination with an anionic surface active agent such as sodium diisobutyl naphthalene sulfonate (See, Col. 1, lines 20–25, and Col. 2, lines 18 and 36). However, the composition set forth in the Farrish patent is used for disinfecting and cleansing to destroy harmful microorganisms. Also, this composition includes only two active ingredients rather than three active ingredients.

Other detergent compositions which include various combinations of surface active agents along with chelating agents are set forth in the following U.S. patents: Wohlberg, 3,492,238; Minklei, 3,630,865; Stimberg, 3,751,370; Mizuno, 3,764,559; Nuzz, 4,199,381; Fox, 4,284,435; Kuhn, 4,721,532; and Stehlin, et al., 4,725,281.

SUMMARY OF THE INVENTION

It is an object of the present invention to provide a detergent composition which is utilized to clean metal surfaces prior to the replating of the same metal or the plating of other metals onto this pre-cleaned metal surface.

It is a further object of the present invention to provide a composition which is available either in a concentrated form, or is to be highly diluted into an aqueous solution, containing the following three active ingredients: (a) sodium diisopropylnaphthalene sulfonate; (b) trisodium nitrilotriacetate, or ethylene diamine tetraacetate; and (c) sodium diethanol glycinate.

It is another object of the present invention to provide a cleaning agent composition to cleanse the epidermis of an animal and to remove animal oils and neutral compounds composed of carbon, hydrogen and oxygen secreted from the sebaceous glands.

The above objects are accomplished, in accordance with the present invention, by providing a liquid concentrate mixture composition for use in the cleaning of a surface comprising: (a) from 40 percent to 80 percent by weight of the alkali metal salt of a dialkylnaphthalene sulfonate, each of said alkyl having from 1 to 8 carbon atoms; (b) from 10 percent to 30 percent by weight of the alkali metal salt of nitrilotriacetic acid or of ethylene diamine tetracetic acid; (c) from 10 percent to 30 percent by weight of the alkali metal salt of N,N-diethanol glycine; and wherein the weight of each of (a), (b) and (c) is based upon the total weight of the liquid concentrate.

The liquid concentrate can be dissolved in water and can comprise from 0.5 percent to 10 percent by weight of the aqueous solution bath which is produced, with the weight based upon the total bath weight.

The alkyl is selected from the group consisting of methyl, ethyl, propyl, isopropyl, n-butyl, isobutyl, tert.-butyl, pentyl, hexyl, heptyl and octyl, and is preferably isopropyl. The alkyl has from 1 to 8 carbon atoms, and can have 7 to 8 carbon atoms, or can have 4 to 6 carbon atoms, and preferably has 1 to 3 carbon atoms, and most preferably has 3 carbon atoms.

The present invention further provides an electrochemical cleaning method to remove oxide film from a metal surface to be cleaned to permit plateability of a metal onto said cleaned metal surface comprising: (1) providing an aqueous solution composition bath comprising: (A) from 0.5 percent to 10 percent by weight of a liquid concentrate mixture comprising: (a) from 40 percent to 80 percent by weight of the alkali metal salt of a dialkyl naphthalene sulfonate, each of said alkyl having from 1 to 8 carbon atoms; (b) from 10 percent to 30 percent by weight of the alkali metal salt of nitrilotriacetic acid or of ethylene diamine tetracetic acid; (c) from 10 percent to 30 percent by weight of the alkali metal salt of N,N-diethanol glycine; and wherein the weight of each of (a), (b) and (c) is based upon the total weight of the liquid concentrate; and (B) from 90 percent to 99.5 percent by weight of water; wherein the weight of each of (A) and (B) is based upon the total weight of the aqueous composition bath; and (2) immersing a metal surface into said aqueous solution composition bath.

In addition, the present invention provides a process for cleansing the epidermis of a warm-blooded animal comprising: topically applying to the epidermis of a warm-blooded animal an effective cleansing amount of an aqueous composition comprising: (A) from 0.5 percent to 10 percent by weight of a liquid concentrate mixture comprising: (a) from 40 percent to 80 percent by weight of the alkali metal salt of a dialkyl naphthalene sulfonate, each of said alkyl having from 1 to 8 carbon atoms; (b) from 10 percent to 30 percent by weight of the alkali metal salt of nitrilotriacetic acid or of ethylene diamine tetracetic acid; (c) from 10 percent to 30 percent by weight of the alkali metal salt of N,N-diethanol glycine; and wherein the weight of each of (a), (b) and (c) is based upon the total weight of the liquid concentrate; and (B) from 90 percent to 99.5 percent by weight of water; and wherein the weight of each of (A) and (B) is based upon the total weight of the aqueous composition.

Preferably, the dialkyl naphthalene sulfonate of (a) comprises from 60 percent to 80 percent by weight; more preferably from 40 percent to 60 percent by weight. Preferably, the nitrilotriacetic and/or the EDTA of (b) comprises from 10 percent to 20 percent by weight; more preferably from 20 percent to 30 percent by weight. Preferably, the N,Ndiethanol glycine of (c) comprises from 10 percent to 20 percent by weight; more preferably from 20 percent to 30 percent by weight The formulation mixture of the invention is useful either as a concentrate, or in dilute aqueous solution, also for application to the epidermis of a warm-blooded animal so that this formulation cleanses and removes animal oils and neutral compounds composed of carbon, hydrogen and oxygen secreted from the sebaceous glands. This is particularly useful in cleansing and rinsing the human scalp, thus allowing oxygen to reach the hair follicle depression helping the follicular to function naturally.

If the detergent composition is utilized to cleanse the epidermis of an animal, then it is applied topically in an effective amount which ranges from 10 to 850 mg/kg of animal body weight, preferably from 50 to 600 mg/kg, and most preferably, from 100 to 500 mg/kg.

The detergent composition can be utilized to clean a metal surface prior to the replating of the same metal thereon or prior to the plating of other metals onto this pre-cleaned metal surface. Specifically, the composition, which is available either in a concentrated mixture formulation, or is to be highly diluted into an aqueous solution, contains the following three active ingredients: (a) sodium diisopropylnaphthalene sulfonate; (b) trisodium nitrilotriacetate, or ethylene diamine tetraacetate; and (c) sodium diethanol glycinate. Thus, the preferred alkali metal salt is the sodium salt.

This plating aid surface activator composition may be prepared as a concentrate, which can then be diluted with a very large proportion of water, in order to produce the final aqueous solution. Generally speaking, the plating aid composition is an electrolyte combination of surfactants or wetting agents, in combination with chelating or sequestering agents. It is this combination of surfactants and chelating agents which provides an excellent cleaner for the metal surfaces, in preparation for plating with the same or other metals. The surfactants aid in plating by activating the metal surface prior to plating, due to cleaning the metal surface of oxide films to create active site to attach the deposited metal atoms onto the cleaned substrate.

The metals useful as cations in solution or as substrate in the plating can be, for example, copper, nickel, silver, gold or chromium. Stainless steel is also useful as a substrate.

This aqueous plating aid composition may be used in combination with an acid environment, based upon sulfuric acid or hydrochloric acid, or it may be used in the presence of a basic environment based upon alkali metal hydroxides, such as sodium hydroxide, and including sodium cyanide and nitric acid.

Electrochemical cleaning is necessary to remove metal oxide films from a metal surface to allow plateability onto the metal surface of a new metal coating. Although these metal oxide films contribute to poor surface adhesion or surface peeling, once these films have been removed, any applied metal coatings are acceptable to coat the metal substrate, as the surface to be plated becomes clean and compatible to receive a new coating.

When using the formulation of the invention as an electrolyte in an aqueous electrochemical cleaning bath for a metal surface, the metal surface is electrically connected to the anode. When using the formulation of the invention as an electrolyte in an aqueous metal plating bath for a metal surface substrate, the metal substrate is electrically connected to the cathode; and metal cations dissolved in the plating bath will coat this metal substrate. A direct electric current is passed between the cathode and the anode through the aqueous bath containing this electrolyte in both types of bath. The third use is to utilize the formulation of the invention in a bath for metal cleaning in which no electric field is employed. However, it may sometimes be desirable to provide for vigorous agitation of the bath after the metal is immersed therein by such means as: mechanical stirrer.

When materials in the prior art cleaning solution interfere with the plating operation, the substrate rejects the new coating. Improper cleaning in the prior art is the cause of poor bonding onto the substrate metal surface. Pitting and poor corrosion resistance indicate that originally present soil agents such as metal oxide films remained on the surface of the metal part.

Precleaning methods used before plating can sometimes include wet or dry sand blasting, solvent cleaning, alkaline cleaning or acid cleaning. Alkaline cleaners can be used to electro-clean the surface of the metal part to be later plated. Dipping into a acid bath is generally used as the next step in the cleaning cycle because the acid will neutralize the alkali cleaner and will microetch the surface.

Surfactants or surface active wetting agents reduce surface tension and provide for wettability between the aqueous solution and the surface to be cleaned. These wetting agents also contribute to detergent activity of the organic liquid mixture as a concentrate, or as a component, of the aqueous solution.

Chelating agents are preferably the trisodium salt of nitrotriacetic acid, or of EDTA, and these sequestering compounds hold the metal ion in solution. It is this combination of surfactants and chelating agents which provides an excellent cleaner for metal surfaces in preparation for plating.

The voltage utilized for the electrochemical processing using the formulation of the invention ranges from between 2 to 8 volts direct current (D.C.).

Of particular value are the superior results found when the cleaning composition is used to activate a preexisting nickel surface. In the prior art, it is known that nickel which had been previously plated more than 24 hours ago becomes passive. Oxides also form on the old plated nickel surface in contact with prior art baths, and the part must be cleaned to remove the passive nickel. It has now surprisingly been found that, with the use of the metal surface detergent cleaner according to the invention, there is no further need to strip old nickel off the nickel plated part.

The detergent cleaner and metal activator of the invention is, therefore, a metal-aid activator which provides excellent adhesion when cleaning and activating a metal surface to plate a metal coating onto a substrate of nickel, silver, gold, stainless steel and other metals.

The following is an example of the formulation composition for the metal-aid plating activator of the invention. Initially, a mixture of organic liquids may be prepared as a concentrate having the following amounts of ingredients:

(a) 8 oz/gal to 75 oz/gal sodium diisopropyl naphthalene sulfonate: (b) 13 oz/gal to 25 oz/gal trisodium nitrilotriacetate or 13 oz/gal to 25 oz/gal ethylene diamine tetraacetate (EDTA) as a substitute; and (c) 9 oz/gal to 25 oz/gal sodium diethanolglycinate.

Upon mixing and blending the compounds, a baume reading is necessary. A hydrometer with a 0–26 baume range is preferred. The preferred baume reading will be between 10–12.

From one gallon of this organic mixture concentrate formulation, it is possible in one embodiment to use eight ounces of concentrate which is added to about 40 gallons of water. In another embodiment, it is possible to use 5 gallons of concentrate and 35 gallons of water for a total of 40 gallons aqueous solution. Thus, the concentrate may comprise from 0.5 percent to 35 percent by weight of the total aqueous solution; or the concentrate may comprise from 0.5 percent to 15 percent by weight of the total aqueous solution; or the concentrate may comprise from 0.5 percent to 10 percent by weight of the total aqueous solution; the balance being water.

The organic constituents present in the metal-aid activator for the final aqueous bath solution can be only a few tenths of a percent and still achieve superior results. In summary, the metal-aid solution is a water-base electrolyte solution containing from 90 percent to 99.5 percent by weight of water, and from 0.5 to 10 percent by weight organic liquid concentrate.

The composition is a metal plating bath additive formulation and an electrolyte that contains wetting agent and chelating agent ingredients that aid in removing unwanted coatings from a metal surface or substrate and then aid in the deposition of a new coating on the cleansed metal substrate. Metal-aid activator enables the plating of nickel over nickel, gold over nickel or chromium over chromium, for example, with a perfect bond and 100 percent adhesion.

The metals to be used for plating in an aqueous plating bath are desirably present in solution, as the metal cation resulting from dissolving in the bath the metal salt of a strong mineral acid. Examples include either the nitrate, the sulfate or the hydrochloride salt of the metal in the ratio of from 0.5 to 15 oz of cation/gal of solution, preferably 1 to 10 oz of metal cation/gal of solution.

The formulation can be used as an electrolyte in an aqueous plating bath for the metal ions, such as copper, nickel, chromium, silver and gold to eliminate passivation and to promote lamination on the metal substrates of copper, nickel, chromium, silver, gold or stainless steel.

The temperature of the aqueous bath system is room temperature, unless otherwise indicated.

When plating gold onto a nickel substrate with the use of the metal-aid activator composition, the cleaning or coating power increases at the low current density range. The same result is accomplished when activating copper, chromium or gold substrates for future deposition of a metal coating thereon.

The composition and method of the invention have the further advantages that if a previously applied first metal coating is not peeling, nor is burned, it is not necessary to strip off this first coating. Before replating the nickel or chromium onto a substrate, it is not necessary to remove the substrate. Replating the new coating can be done onto the old coating without intermediate removal or stripping. Thus, replating problems are gone with the use of metal-aid activator. When activating chromium over chromium, acid should not be used in metal-aid activator solution bath.

When plating a second coating of chromium over a first coating of chromium, with the metal-aid activator solution bath, it is desirable to keep the voltage from exceeding about 6 volts D.C. When using a plating voltage of 6 volts D.C., the metal-aid activator enables the current to flow so efficiently and so much faster at the re-chromed plated area. Metal-aid activator is prepared in a concentrated form, and then is diluted in aqueous solution to the proper concentration for effective utilization for this metal plating operation.

DETAILED DESCRIPTION OF THE PREFERRED EMBODIMENT

Other objects and features of the present invention will become apparent from the following detailed description considered in connection with the accompanying examples which disclose one embodiment of the present invention. It should be understood, however, that these examples are designed for the purpose of illustration only and not as a definition of the limits of the invention.

EXAMPLE 1

Replating: Nickel over Nickel, Gold over Nickel, and Chrominum over Chromium, or Chromium Skip, with Metal-Aid Activator.

If the nickel plated metal parts have previously been plated within the previous 24 hours, an electric current in the metal-aid activator bath tank should not be used. Instead, immersion is used.

CYCLE: activation and replating using the metal-aid formulation;

STEP 1: Electro-clean to remove chromium by reverse current of 2 volts D.C. for 30 seconds with metal part connected to anode. Clean the activator bath and free from chromates. Chromium is stripped off substrate using this cleaner;

STEP 2 Water rinse;

STEP 3: Metal-aid activator bath tank at least 20 seconds residence time, 2 volts D.C.; metal part is connected to cathode;

STEP 4: Water rinse;

STEP 5: Immerse metal part in nickel plating solution bath containing nickel ion concentration of 3 to 4 oz $Ni^{++}$/gal;

BATH FORMULATION: (40 gallon bath make-up solution)

STEP 1: 35 gallons of water;

STEP 2: Preparing 5 gallons of metal-aid activator concentrate, comprising mixing the following ingredients together in a weight ratio of 1:2:1: sodium diisopropyl naphthalene sulfonate (8 parts by weight); trisodium nitrilotriacetate (16 parts by weight); and sodium diethanolglycinate (8 parts by weight).

STEP 3: Add in 2 percent HCl by volume or 2 percent by weight sulfuric acid. and mix together the 35 gallons of water and the 5 gallons of concentrate; and including 8 oz/gal NaCN.

STEP 4: 2 volts of direct current, or by immersion without electric current;

STEP 5 Room temperature, 20 second residence time;
STEP 6: Use stainless steel tank for anode;
STEP 7: Maintain a pH 1.5.

When activating barrel nickel plated parts, use 4-6 volts D.C. and 3-5 minutes during step number 4 in the metal-aid bath.

REPLATING CHROMIUM OVER CHROMIUM OR CHROMIUM SKIP

STEP I: Water rinse;
STEP 2: Immerse in metal-aid activator bath (at least 20 seconds residence time); no electric current;
STEP 3: Water rinse;
STEP 4: Chromium plating bath solution containing chromium ion concentration of 2 to 3 oz $Cr^{+++}$/gal. solution.

Chromium is plated over chrome skip, without stripping off the first coating of chromium. Eliminate chrome rejects by installing and utilizing the metal-aid formulation between the nickel and the chromium bath solutions.

BATH CONTROL: Use hydrometer reading from 0 to 10, baume control, by keeping baume at 1.0 (when bath is first made up), pH is kept at 1.5.

EXAMPLE 2

Metal-aid composition makes it possible to plate chromium over nickel and to eliminate chromium skip. It is also possible to plate nickel over nickel with 100 percent adhesion. The metal-aid activator can be installed between the nickel tank and the chromium tank.

METAL-AID ACTIVATOR BATH FORMULATION

STEP 1: preparing 5 gallons of concentrate formulation comprising mixing together in a weight ratio of 2:2:1 the ingredients sodium diisopropyl naphthalene sulfonate, 16 parts by weight; EDTA, 16 parts by weight; and sodium diethanolglycinate, 8 parts by weight;
STEP 2: add 35 gallons of water to the concentrate;
STEP 3: add 80 oz. of sulfuric acid or of HCl gas at S.T.P.

Activating time is at least 20 seconds residence time.

CYCLE USING METAL-AID BATH

STEP 1: Nickel plating with nickel ion concentration of 2 to 3 oz $Ni^{++}$/gal at 3 to 4 volts D.C.;
STEP 2: Water rinse;
STEP 3: Metal-aid bath by immersion; no electric current;
STEP 4: Water rinse;
STEP 5: Repeat nickel plating or chromium plating.

The above cycle will eliminate chrome rejects.

EXAMPLE 3

Metal-Aid Activator Bath Formulation

STEP 1: 5 gallons of metal-aid concentrate formulation are prepared by mixing together in a weight ratio of 3:2:1 the ingredients sodium diisopropyl naphthalene sulfonate, 24 parts by weight; trisodium nitrilotriacetate, 16 parts by weight; and sodium diethanolglycinate, 8 parts by weight;
STEP 2: add 35 gallons of water to the concentrate;
STEP 3: add at least 3 lbs. of caustic soda (48 oz), in order to maintain pH in the range of 10.5 to 11.5.

CYCLE ON METAL-AID BATH

STEP 1: Electro-clean nickel substrate at D.C. current of 3 to 4 volts with workpiece connected to anode; bath is then freed from chromates;
STEP 2: Water rinse;
STEP 3: Place in metal-aid bath at 2 volts D.C.; use tank for anode electrode and connect work pieces to cathode electrode;
STEP 4: Water rinse;
STEP 5: Nickel plating in a bath having a nickel ion concentration of 2 to 3 oz $N^{++}$/gal.

The above cycle will plate nickel over previously plated nickel, with 100 percent adhesion and a perfect bond.

EXAMPLE 4

Replating Nickel Plated Objects

When activating nickel plated objects which were previously nickel plated within 24 hours earlier, the activation is done by immersion using metal-aid formulation, without an electric current.

When activating nickel objects which were previously nickel plated more than 24 hours earlier, use direct current in metal-aid activator bath, with the tank as anode and the workpiece as cathode. The voltage can be usually 2 volts D.C. or lower used when activating objects in the metal-aid bath; and the voltage preferably does not exceed 8 volts.

EXAMPLE 5

Stripping Chromium Off Nickel and Make-Up Bath Solution for Stripping Chromium STEP 1: 300 gallon tank containing 100 gallons of metal aid concentrate formulation comprising mixing together in a weight ratio of 4:2:1 the ingredients sodium diisopropyl naphthalene sulfonate, (32 parts by weight); trisodium nitrilotriacetate, (16 parts by weight); sodium diethanolglycinate, (8 parts by weight). Add 85 gallons of water and add 85 gallons of caustic NaOH to produce a pH in range of 10 to 11.5;
STEP 2: St ripping time 2 to 3 minutes at 7-8 volts D.C. reverse current with workpiece connected to anode. No heat added at room temperature;
STEP 3: Water rinse;
STEP 4: Second stripping solution is some as in STEP 1 with additional caustic soda to keep pH at 10 to 11.5; 7-8 volts D.C. reverse current; 2 minutes will strip off all the chromates on the surface of the nickel;
STEP 5: Water rinse.

EXAMPLE 6

Activation of Nickel over Nickel with Metal-Aid

Activation for replating nickel over nickel substrate after chromium was stripped off nickel substrate, with 100 percent adhesion and a perfect bond (see cycle below).

STEP 1: Reverse current for 30 seconds, use same electrocleaner as in STEP 1 of Example 5;
STEP 2: Water rinse;
STEP 3: Dip part into 20 percent by weight aqueous HCl solution for 30 seconds at 2 volts D.C.;
STEP 4: Water rinse;
STEP 5: Metal-aid bath in tank, 2 volts direct current for 20 seconds;

STEP 6: Water rinse;

STEP 7: Nickel plate using an aqueous plating bath containing nickel ion concentration of 5 to, 6 oz Ni++/gal.

Nickel was replated over old nickel substrate after chromium was stripped off of nickel substrate, with 100 percent adhesion, using the metal-aid activator composition.

EXAMPLE 7

Plating Copper, Nickel, Chromium and Silver over Stainless Steel

STEP 1 Clean stainless steel workpiece, so that the surface is very clean;

STEP 2: Place in metal-aid bath 30 seconds. Use 2 volts D.C., no added heat; attach workpiece to anode;

STEP 3: Water rinse;

STEP 4: Place in HCl acid bath, pH is 2;

STEP 5: Water rinse;

STEP 6: Metal-aid bath (with or without current) containing 35 gallons of water with 5 gallons of metal aid concentrate formulation comprising mixing together in a weight ratio of 5:2:1 the ingredients sodium diisopropyl naphthalene sulfonate, (40 parts by weight); trisodium nitrilotriacetate, (16 parts by weight); and sodium diethanolglycinate, (8 parts by weight);

STEP 7: Water rinse;

STEP 8: Copper, nickel, chromium or silver can be plated at 3 to 5 volts D.C. onto stainless steel, with a perfect bond and 100 percent adhesion, with the use of metal-aid activator formulation of the invention; metal cation concentration of 3 to 4 oz/gal.

EXAMPLE 8

Comparative Examination of Performance of Metal-Aid Activator as Compared with Acid Activator, Hydrochloric Acid Solution, Sulfuric Acid Solution, NAS-S

ITEM OF COMPARATIVE EXAMINATION

EXAMPLE 8(a): Adhesion of nickel deposit on nickel plating by dipping in acid activating solution;

EXAMPLE 8(b): Adhesion of chromium deposit on chromium plating by dipping in acid activating solution;

EXAMPLE 8(c): Adhesion of nickel deposit on nickel plating by cathodic electrolysis in acid activating solution;

EXAMPLE 8(d): Adhesion of chromium deposit on chromium plating by cathodic electrolysis in acid activating solution.

RESULTS

EXAMPLE 8(a)

Adhesion of Nickel on Nickel by Dipping

| | |
|---|---|
| Bright nickel plating | Watt type bath brightener (foam-inhibiting urethane) |
| Water rinse 30 seconds | 2.5 A/dm$^2$, 50–53° C.<br>15 min. air agitation<br>Nickel ion concentration of 2 to 3 oz/gal |

Activating

Water rinse 30 sec.;
bright nickel plating;
water rinse;
drying.

TABLE I

| Activating Condition (RT = Room Temperature) | | 1st | 2nd |
|---|---|---|---|
| acid<br>RT. 30 sec. | 100 g/l | 3 | 3 |
| acid<br>60° C., 30 sec. | 100 g/l | 2 | 3 |
| Hydrochloric acid<br>60° C., 30 sec. | 100 ml/l | 2 | 1 |
| Hydrochloric acid<br>60° C. 30 sec. | 150 ml/l | 3 | 2 |
| NAS-S<br>RT. 30 sec. | 100 ml/l | 2 | 1 |
| NAS-S<br>RT. 30 sec. | 200 ml/l | 2 | 2 |
| Metal-aid<br>RT. 30 sec. | 100% | 3 | 3 |
| Metal-aid<br>60° C., 30 sec. | 100% | 3 | 3 |
| Metal-aid<br>RT. 30 sec. | 150 ml/l | 2 | 2 |
| Metal-aid<br>60° C., 30 sec. | 150 ml/l | 2 | 2 |
| Metal-aid<br>Hydrochloric acid<br>RT. 30 sec. | 150 ml/l<br>20 ml/l | 2 | 2 |
| Metal-aid<br>Hydrochloric acid<br>60° C., 30 sec. | 150 ml/l<br>20 ml/l | 2 | 2 |
| Metal-aid<br>Hydrochloric acid<br>60° C., 30 sec. | 150 ml/l<br>50 ml/l | 2 | 2 |

by bending test and marked as follows 1. good adhesion and no defects visible in surface;
2. a small amount of defect in adhesion visible up to 10 percent of surface area;
3. major amount of defect in adhesion visible over 50 percent or more of surface area;

EXAMPLE 8(b)

Adhesion of Chromium on Chromium by Dipping

| | |
|---|---|
| Chromium plating | Fluorosilicate bath<br>15 A/dm$^2$, 45–50° C.<br>chromium ion concentration of 3 to 4 oz/gal. |
| Water rinse | 1 min. |

Activating

Water rinsing
Chromium plating
Water rinsing
Drying

TABLE II

| Activating Condition | | 1 | 11 |
|---|---|---|---|
| acid<br>RT. 30 sec. | 50 g/l | gray cloud | good |
| Sulfuric acid<br>RT. 30 sec. | 50 g/l | creamy white clouding | good |
| Nothing | | gray cloud | good |
| Metal-aid<br>RT. 30 sec. | 150 ml/l | creamy white clouding | good |
| Metal-aid<br>40° C., 30 sec. | 150 ml/l | gray cloud | spot |
| Metal-aid<br>Hydrochloric acid<br>RT. 30 sec. | 150 ml/l<br>20 ml/l | gray cloud | good |
| Metal-aid<br>Hydrochloric acid<br>40° C., 30 sec. | 150 ml/l<br>20 ml/l | gray cloud | white cloud |
| Metal-aid<br>Sulfuric acid | 150 ml/l | white cloud | good |

TABLE II-continued

| Activating Condition | I | II |
|---|---|---|
| RT. 30 sec. | | |

EXAMPLE 8(c)

Adhesion of Nickel on Nickel by Electrolytic Activating

| | |
|---|---|
| Bright nickel plating | Watt type bath brightener |
| Water rinse | 2.5 A/dm$^2$ |
| | 45-50° C. |
| | 15 min. air agitation |
| | Nickel ion concentration in bath of 5 to 6 oz/gal |

Activating

Water rinse
Bright nickel plate
Water rinse
Drying

TABLE III

| Activating Condition | | Opposite Electrode stainless steel | Opposite Electrode carbon |
|---|---|---|---|
| acid | 50 g/l | 3 | — |
| Cathodic 2.5 V RT. 30 sec. | | | |
| acid | 50 g/l | 2 | 2 |
| Cathodic 2.5 V 40° C. 30 sec. | | | |
| Sulfuric acid | 50 g/l | 1 | — |
| Cathodic 2.5 V RT. 30 sec | | | |
| Sulfuric acid | 100 g/l | 2 | 3 |
| Cathodic 2.5 V RT. 30 sec. | | | |
| Hydrochloric acid | 50 ml/l | 2 | 2 |
| Cathodic 1.5 V RT. 30 sec. | | | |
| Hydrochloric acid | 10 ml/l | 3 | 3 |
| Cathodic 1.5 V RT. 30 sec. | | | |
| NAS-S | 100 ml/l | 2 | 2 |
| Cathodic 1.5 V RT. 30 sec. | | | |
| Metal-aid | 50 ml/l | 1 | 1 |
| Hydrochloric acid | 15 ml/l | | |
| Cathodic 2 V, RT. 30 sec. | | | |
| Metal-aid | 50 ml/l | 1 | 1 |
| Hydrochloric acid | 30 ml/l | | |
| Cathodic 2 V, RT. 30 sec. | | | |
| Metal-aid | 100 ml/l | 1 | 1 |
| HCl | 20 ml/l | | |
| Cathodic 2 V, RT. 15 sec. | | | |
| Metal-aid | 100 ml/l | 1 | 1 |
| HCl | 20 ml/l | | |
| Cathodic 2 V, RT. 30 sec. | | | |
| Metal-aid | 150 ml/l | 1 | 1 |
| HCl | 20 ml/l | | |
| Cathodic 2 V, RT. 15 sec. | | | |
| Metal-aid | 150 ml/l | 1 | 1 |
| HCl | 20 ml/l | | |
| Cathodic 2 V RT. 30 sec. | | | |
| Metal-aid | 150 ml/l | 1 | 1 |
| HCl | 20 ml/l | | |
| Cathodic 2 V 40° C. 30 sec. | | | |
| Metal-aid | 150 ml/l | 1 | 1 |
| HCl | 20 ml/l | | |
| Cathodic 1 V RT. 30 sec. | | | |

TABLE III-continued by bending test and marked as follows:
1. good adhesion and no defects visible in surface.
2. a small amount of defect in adhesion, visible up to 10 percent of surface area;
3. major amount of defect in adhesion, visible over 50 percent or more of surface area.

EXAMPLE 8(d)

Adhesion of Chromium on Chromium by Electrolytic Activating

| | |
|---|---|
| Chromium plating | Fluorosilicate bath |
| | 15 A/dm$^2$ |
| | 45-50° C. |
| Water rinsing | 1 min. |
| | chromium ion concentration in bath of 4 to 5 oz/gal |

Activating

Water rinsing
Chromium plating
Water rinsing
Drying

TABLE IV

| Activating Condition | | I | II |
|---|---|---|---|
| Sulfuric Acid | 50 g/l | creamy white clouding | good |
| Cathodic 2 V RT. 30 sec. | | | |
| Sulfuric acid | 50 g/l | creamy white clouding | good |
| Cathodic 2 V RT. 30 sec. | | | |
| Metal-aid | 30 ml/l | creamy white clouding | good |
| HCl | 15 ml/l | | |
| Cathodic 2 V RT. 30 sec. | | | |
| Metal-aid | 150 ml/l | creamy white clouding | good |
| HCl | 20 ml/l | | |
| Cathodic 2 V RT. 30 sec. | | | |
| Metal-aid | 150 ml/l | creamy white clouding | good |
| HCl | 10 ml/l | | |
| Cathodic 2 V RT. 30 sec. | | | |
| Metal-aid | 100% | gray clouding | spot |
| HCl | 20 ml/l | | |
| Cathodic 2 V RT. 30 sec | | | |

CONCLUSIONS

Nickel on Nickel Plating

As a result of adhesion test by dipping activation, NAS-S and hydrochloric acid solution can give only fair to poor adhesion. When the cathodic electrolysis in metal-aid activator solution of the invention is used, perfect adhesion (no visible defects) can be obtained over a wide range of operating conditions.

| Preferred operating condition (electrolysis) | |
|---|---|
| Metal-aid | 50-150 ml/l |
| Hydrochloric acid | 15-20 ml/l |
| pH | below 1.5 |
| voltage | 1.5-3 V D.C. |
| current density | 0.4-1.0 A/dm$^2$ |
| temperature | RT. to 40° C. |
| residence time | 15-60 sec. |

Chromium on Chromium Plating

"1" in the table means constant voltage applied at the start of chromium plating, and "11" means slowly increasing voltage applied. Generally, "11" method is applied in chromium plating. Metal-aid formulation provides best results when used without acid.

EXAMPLE 13

Examination of performance of metal-aid formulation as compared with hydrocholoric acid solution.

ITEM OF EXAMINATION

Adhesion of gold deposit on nickel plating by cathodic electrolysis in activating solution.

RESULTS

Adhesion of gold on nickel by dipping

| | | oz/gal |
|---|---|---|
| copper plate | | |
| water rinse | metallic gold | 0.25 |
| | potassium cyanide | 2.0 |
| Activating | sodium phosphate | 0.5 |
| | 70° C., 0.5 A/dm$^2$ | |
| water rinse | plating thickness 0.00025 mm | |
| nickel plate | | |
| water rinse | | |
| Activating | | |
| water rinse | | |
| gold plate | | |

TABLE V

| Activating Condition | | 1st | 2nd |
|---|---|---|---|
| Hydrochloric acid 40° C., 30 sec. | 128 oz/gl | 2 | 3 |
| Hydrochloric acid 40° C., 30 sec. | 96 oz/gl | 3 | 2 |
| Hydrochloric acid 40° C., 30 sec. | 64 oz/gl | 2 | 2 |
| Hydrochloric acid 40° C., 30 sec. | 32 oz/gl | 2 | 1 |
| Metal-aid 2 Volts D.C. RT. 30 sec. | 128 oz/gl | 2 | 2 |
| Metal-aid 2 Volts D.C. RT. 30 sec. | 64 oz/gl | 2 | 2 |
| Metal-aid 2 Volts D.C. RT. 30 sec. | 32 oz/gl | 1 | 1 |
| Metal-aid 2 Volts D.C. RT. 30 sec. | 16 oz/gl | 1 | 1 |
| Metal-aid 2 Volts D.C. RT. 30 sec. | 8 oz/gl | 2 | 1 |

by bending test and marked as follows:

1. good adhesion and no defects visible in surface;
2. a small amount of defect in adhesion, visible up to 10 percent of surface area;
3. major amount of defect in adhesion, visible over 50 percent or more of surface area.

CONCLUSION 1. gold over nickel

As a result of test by dipping activation hydrochloric acid can yield fair results sometimes. When the cathodic electrolysis in metal-aid activator solution is used, according to the invention, perfect adhesion (no-visible defects in surface) can be obtained under wide range of operating conditions.

| Preferred operating condition (electrolysis) | |
|---|---|
| Metal-aid | 16 oz/gl |
| Voltage | 1.5-3 V D.C. |
| Temperature | RT. to 40° C. |
| Residence time | 15-30 sec. |
| Current density | 0.4-1.0 A/dm$^2$ |

While only a single embodiment of the present invention has been shown and described, it is to be understood that many changes and modifications may be made thereunto, without departing from the spirit and scope of the invention as defined by the appended claims.

What is claimed is:

1. An electrochemical cleaning method to remove oxide film from a metal surface to be cleaned to permit plateability of a metal onto said cleaned metal surface comprising:

(1) providing an aqueous composition bath comprising:

(A) from 0.5 percent to 10 percent by weight of a liquid concentrate mixture comprising;

(a) from 40 percent to 80 percent by weight of the alkali metal salt of a dialkyl naphthalene sulfonate, each of said alkyl having from 1 to 8 carbon atoms;

(b) from 10 percent to 30 percent by weight of the alkali metal salt of nitrilotriacetic acid or of ethylene diamine tetracetic acid;

(c) from 10 percent to 30 percent by weight of the alkali metal salt of N,N-diethanol glycine; and wherein the weight of each of (a), (b) and (c) is based upon the total weight of the liquid concentrate; and (B) from 90 percent to 99.5 percent by weight of water;

wherein the weight of each of (A) and (B) is based upon the total weight of the aqueous composition bath; and (2) immersing a metal surface to be cleaned into said aqueous solution composition bath.

2. The electrochemical cleaning method of claim 1 further comprising:

(3) immersing an anode and a cathode into said aqueous composition bath;

(4) electrically connecting said metal surface to said anode; and (5) passing an electrical current between said anode and said cathode to clean said metal surface.

* * * * *